US005567354A

United States Patent [19]

Schwendimann et al.

[11] Patent Number: 5,567,354

[45] Date of Patent: Oct. 22, 1996

[54] INHIBITOR OF THE CORROSION OF A METAL MATERIAL SUCH AS STEEL

[75] Inventors: Christian Schwendimann, Metz; Jacques Keller, Florange; Jean-Luc Auger, Fameck; Philippe Fatrez, Chieulles, all of France

[73] Assignee: Sollac (Societe Anonyme), Puteaux, France

[21] Appl. No.: 346,188

[22] Filed: Nov. 22, 1994

[30] Foreign Application Priority Data

Dec. 14, 1993 [FR] France ..... 93 15196

[51] Int. Cl.[6] ..... C10M 173/02

[52] U.S. Cl. ..... 252/387; 106/14.14; 508/163

[58] Field of Search ..... 252/49.3, 50, 387; 106/14.14

[56] References Cited

U.S. PATENT DOCUMENTS

| | | | |
|---|---|---|---|
| 2,243,853 | 2/1939 | Castner . | |
| 3,259,574 | 7/1966 | Morrison et al. | 252/25 |
| 3,296,127 | 1/1967 | Butcosk et al. | 252/25 |
| 3,522,093 | 7/1970 | Woolman . | |
| 3,689,411 | 9/1972 | Messina et al. | 252/25 |
| 3,691,074 | 9/1972 | Messina et al. | 252/25 |
| 4,130,493 | 12/1978 | Inoue | 252/25 |
| 4,257,902 | 3/1981 | Singer | 252/25 |
| 4,713,186 | 12/1987 | Kristen et al. | 252/25 |
| 4,717,490 | 1/1988 | Salentine | 252/25 |

FOREIGN PATENT DOCUMENTS

| | | |
|---|---|---|
| 523793 | 4/1956 | Canada . |
| 524879 | 5/1956 | Canada . |
| 646214 | 8/1962 | Canada . |
| 52-110242 | 9/1977 | Japan . |
| 1182247 | 2/1970 | United Kingdom . |

OTHER PUBLICATIONS

SU–810–783 (Synt Nat Perfumes Institute) 10 Mar. 1981, see Derwent Abstract 92480 D/50 only.

SU–1018–964–A (Dneprodzerzh Ind. In) 23 May 1983, see Derwent Abstract 84–073183/12 only.

SU–1129–225–A (As Azerb Additives) 15 Dec. 1984, see Derwent Abstract 85–163666127 only.

SU 1712393–A1 (As UKR Hard Materials) 15 Dec. 1992, see Derwent Abstract 93–016013/02 only.

SU–1268–609A (As Azerb Additive) 7 Nov. 1986, see Derwent Abstract 87–183652/26 only.

SU–1268–610A (Burtsev A.B.) 7 Nov. 1986, see Derwent Abstract 87–183653/26 only.

SU–595–363 (Kish Poly) Mar. 10, 1978, see Derwent Abstract 05710B/03 only.

SU–667582 (Lvon Poly) 18 Jun. 1979, see Derwent Abstract 14375 C/08 only.

SU–1260–390A (Lavrineko Vi) 30 Sep. 1986) see Derwent Abstract 87–142052120 only.

*Primary Examiner*—Sharon Gibson
*Assistant Examiner*—Valerie Fee
*Attorney, Agent, or Firm*—Sixbey Friedman Leedom & Ferguson

[57] ABSTRACT

The invention relates to a corrosion inhibitor for a metal material such as steel, of the type consisting of an aqueous solution containing an alkali metal nitrite, wherein said solution contains 0.01 to 0.3 mol/l of an alkali metal nitrite, 0.01 to 0.3 mol/l of an alkali metal phosphate, and phosphoric acid in a proportion of a quantity sufficient to maintain the pH of said solution, measured at ambient temperature, between 6.9 and 7.2.

7 Claims, No Drawings

INHIBITOR OF THE CORROSION OF A METAL MATERIAL SUCH AS STEEL

FILED OF THE INVENTION

The invention relates to the field of corrosion inhibitors with Which the surface of metals, especially of steel, is coated before they are stored.

PRIOR ART

Various solutions containing corrosion inhibitors are employed by steel manufacturers for coating, together with oils, the surface of steel sheets after they are rolled and before they are coiled and sent off to the customer who has ordered them. These corrosion inhibitors are intended to passivate the surface of the product (in the case of passivating inhibitors based, for example, on nitrites), by forming a passive film thereon or to form compounds which precipitate at the surface of the product and form a protective film thereon (in the case of nonpassivating inhibitors based, for example, on phosphates), or to cause a neutralization or an alkalifying of the medium next to the surface and an adsorption (in the case of amine-based organic inhibitors). These inhibitors can also serve as lubricants during the subsequent cold working operations on the sheet.

This protection of the sheets using such inhibitors is particularly necessary in the case of steel sheets which have been coated by electrodeposition on only one of their faces. Firstly, during the various stages linked with this treatment, the sheet is in contact with various liquids which may be corrosive to the uncoated face if they are not subsequently completely removed: degreasing and cleaning solutions, electrolyte, rinsing fluids etc. In addition, the atmosphere of the electroplating line is charged with electrolyte salts and acid. All the conditions are therefore combined for requiring a treatment of the uncoated face of the sheet with a corrosion inhibitor in order to avoid its pitting while the reel is being stored.

Inhibitors containing both sodium nitrite $NaNO_2$ and azoles have proved their effectiveness for the protection of steel sheets. However, they cannot be employed for sheets only one face of which is coated and comprises, for example, a deposit of a zinc-nickel alloy, because during coiling the contact between this coating and the inhibitor deposited on the bare face of the adjoining turn causes the appearance of stains on the zinc-nickel layer. However, they do not run the risk of generating nitrosamines during any possible subsequent reheating of the sheet, in contrast to amines. Since nitrosamines are known for their carcinogenic properties, such a possibility of formation must be avoided.

The aim of the invention is to propose a corrosion inhibitor that can be employed on steel sheets coated on only one of their faces, without this inhibitor's damaging the coated face and generating toxic compounds during a subsequent heating.

SUMMARY OF THE INVENTION

To this end, the subject of the invention is a corrosion inhibitor for a metal material such as steel, of the type consisting of an aqueous solution containing an alkali metal nitrite, wherein said solution contains 0.01 to 0.3 mol/l of an alkali metal nitrite, 0.01 to 0.3 mol/l of an alkali metal phosphate, and phosphoric acid in a proportion of a quantity sufficient to maintain the pH of said solution, measured at ambient temperature, between 6.9 and 7.2.

As will be understood, the invention consists in jointly adding an alkali metal phosphate and phosphoric acid to the known sodium-nitrite-based inhibitors, in well-determined proportions, so that a neutral solution is obtained which is noncorrosive to the coated face of the sheets with one zinc-nickel face.

The inventors have found that the appearance of stains on the zinc-nickel coating of the coated face of the sheets whose bare face is protected by sodium nitrite inhibitors was due to the pronounced basicity and to the absence of a buffer medium for these inhibitors. Their pH is approximately 9 to 11, and this causes an alkaline corrosion of the coating by the formation of zincates. The idea underlying the invention is that it is possible to avoid this alkaline corrosion by buffering the inhibitor at a neutral pH compatible with passivation of the iron. This can be carried out by adding a buffer salt to the sodium nitrite. A mixture of sodium phosphate $Na_3PO_4$ and of phosphoric acid $H_3PO_4$ is particularly indicated (it being impossible for the sodium to be replaced with another alkali metal such as potassium). In fact, the nitrite ions and the phosphate ions have synergistic effects in their anticorrosion action, the former acting as neutralizing inhibitors and the latter as passivating inhibitors.

The fact of providing a buffer medium accompanying the corrosion inhibitor harmonizes well with the carrying out of an acidic rinsing before the sheet is coated, and with the optional presence of $K^+$, $Zn^{2+}$ and $Ni^{2+}$ ions in the atmosphere of the electroplating and coiling shop. It is essential for this purpose that the buffer should impose a pH not lower than 6.5, measured at ambient temperature (and therefore under inhibitor placed in aqueous solution and not yet applied to the sheet).

The corrosion inhibitor according to the invention is an aqueous solution of an alkali metal nitrite at a concentration of 0.01 to 0.3 mol/l, and of an alkali metal phosphate at a concentration of 0.01 to 0.3 mol/l, and also containing phosphoric acid at a concentration such that it imposes on the solution a pH of between 6.9 and 7.2, measured at ambient temperature. It is also desirable that the molar concentrations of alkali metal ions of the nitrite and of alkali metals of the phosphate should not differ by more than 20%. By way of example, very good results have been obtained with a solution containing 6 g/l of sodium nitrite, 10 g/l of sodium phosphate $Na_3PO_4 \cdot 12H_2O$, the quantity of phosphoric acid making it possible to adjust the pH to 7, and a nonionic wetting agent.

Its effectiveness has been tested by applying a corrosive solution of chloride ions onto an unoiled sheet, by oiling the metal and subjecting it to cycles successively comprising 8 hours' exposure to a moist atmosphere and 16 hours' exposure to a dry atmosphere. After 68 hours of such a treatment, half as many pits are observed on the sheet when it has been coated with a solution of this inhibitor before the application of the corrosive solution.

A nonionic or anionic wetting agent, such as a phosphoric ester, may be optionally added to this inhibitor solution. This overcomes the poor wettability of the zinc-nickel layer and does so without employing amine-based products in the inhibitor. It is desirable to add a foam suppressor together with the wetting agent. The quantities added may be, for example, from 1 to 5 ml/l of wetting agent and from 0.2 to 1 ml/l of foam suppressor.

The application of the inhibitor fits within the following scheme:

zinc electroplating of the sheet on one of its faces with a zinc-nickel alloy;

acidic rinsing followed by rinsing of the sheet with demineralized water;

application of the inhibitor solution;

drying of the sheet, resulting in the evaporation of water;

oiling of the sheet;

coiling of the sheet and storing or despatch of the coil.

Various methods of application of the inhibitor can be envisaged, for example with the aid of wringing rolls between which the sheet travels and whose lower parts dip in troughs containing the solution including the inhibitor. These wringing rolls must apply, for example, 1 to 2 ml of solution per $m^2$ of sheet (on each face involved in the treatment), corresponding to a quantity of sodium of 2 to 6 $mg/m^2$. It is to be understood that it is possible, at will, to coat both faces of the sheet or only the bare face.

The use of this corrosion inhibitor is, of course, not restricted to the protection of sheets coated with a zinc-nickel alloy on only one face, which is only a preferential application, but it is applicable to the protection of any sheet of steel or even of other metal materials.

We claim:

1. An inhibitor of the corrosion of a metal material consisting of an aqueous solution containing 0.01 to 0.3 mol/l of an alkali metal nitrite, 0.01 to 0.3 mol/l of an alkali metal phosphate and phosphoric acid in a proportion of a quantity sufficient to maintain the pH of said solution, measured at ambient temperature, between 6.9. and 7.2.

2. The corrosion inhibitor as claimed in claim 1, wherein the molar concentrations of alkali metal ions originating from the nitrite and of alkali metal ions originating from the phosphate do not differ by more than 15%.

3. The corrosion inhibitor as claimed in claim 1, wherein said solution also contains a wetting agent.

4. The corrosion inhibitor as claimed in claim 3, wherein said wetting agent is a nonionic or anionic wetting agent.

5. The corrosion inhibitor as claimed in claim 3, wherein said aqueous solution also contains a foam-suppressing agent.

6. The corrosion inhibitor as claimed in claim 1, wherein the total concentration of alkali metal ions from said nitrite and phosphate is greater than 0.10 mol/l.

7. The corrosion inhibitor as claimed in claim 1, wherein said metal material is sheet steel coated on one side with a layer of a zinc-nickel alloy, and said inhibitor is applied to the non-coated side of said sheet steel preventing the appearance of stains on said alloy when said sheet steel is coiled.

* * * * *